US008909478B2

(12) United States Patent
Ikeda et al.

(10) Patent No.: US 8,909,478 B2
(45) Date of Patent: Dec. 9, 2014

(54) METHOD FOR CALCULATING THE RATIO OF RELATIVE PERMEABILITIES OF FORMATION FLUIDS AND WETTABILITY OF A FORMATION DOWNHOLE, AND A FORMATION TESTING TOOL TO IMPLEMENT THE SAME

(75) Inventors: Maki Ikeda, Sartrouville (FR); Sophie Nazik Godefroy, Abingdon (GB); Go Fujisawa, Sagamihara (JP)

(73) Assignee: Schlumberger Technology Corporation, Sugar Land, TX (US)

( * ) Notice: Subject to any disclaimer, the term of this patent is extended or adjusted under 35 U.S.C. 154(b) by 1041 days.

(21) Appl. No.: 12/942,031

(22) Filed: Nov. 9, 2010

(65) Prior Publication Data

US 2011/0054796 A1 Mar. 3, 2011

Related U.S. Application Data

(62) Division of application No. 11/963,758, filed on Dec. 21, 2007, now Pat. No. 7,849,736.

(51) Int. Cl.

| | |
|---|---|
| ***G01V 1/40*** | (2006.01) |
| ***E21B 49/08*** | (2006.01) |
| ***E21B 43/38*** | (2006.01) |
| ***E21B 47/10*** | (2012.01) |

(52) U.S. Cl.

CPC ..... *E21B 49/081* (2013.01); *E21B 43/38* (2013.01); *E21B 47/10* (2013.01)

USPC ..... 702/6

(58) Field of Classification Search

CPC ..... G01N 24/081

USPC ..... 702/6–18

See application file for complete search history.

(56) References Cited

U.S. PATENT DOCUMENTS

| | | | | |
|---|---|---|---|---|
| 3,079,085 | A | 2/1963 | Clark, Jr. et al. | |
| 4,622,643 | A | 11/1986 | Dotson | |
| 4,638,447 | A | 1/1987 | Odeh | |
| 5,269,180 | A * | 12/1993 | Dave et al. | 73/152.06 |
| 5,296,180 | A | 3/1994 | Hayes et al. | |
| 7,032,661 | B2 | 4/2006 | George et al. | |
| 2004/0055745 | A1 | 3/2004 | Georgi et al. | |
| 2006/0008913 | A1 | 1/2006 | Angelescu et al. | |
| 2006/0243047 | A1 | 11/2006 | Terabayashi et al. | |

FOREIGN PATENT DOCUMENTS

RU 2074316 2/1997

OTHER PUBLICATIONS

H. Elshahawi, K. Fathy, S. Hiekal, "Capillary Pressure and Rock Wettability Effects on Wireline Formation TesterMeasurements", SPE 56712, pp. 1-16.

John J. Buckles, Randy D. Hazlett, Shiyi Chen, Kenneth G. Eggert, Daryl W. Grunau, and Wendy E. Soll, "Toward Improved Prediction of ReservoirFlow Performancesimulating oil and water flows at the pore scale", Los Alamos Science No. 22 1994, pp. 112-121.

(Continued)

*Primary Examiner* — Stephen Cherry

(74) *Attorney, Agent, or Firm* — Daryl R. Wright; Jody DeStefanis

(57) ABSTRACT

A method and a tool that implements a method which includes measuring the viscosity and flow rates of formation fluids and obtaining the ratio of relative permeabilities of the formation fluids and wettability of the formation using the same.

5 Claims, 5 Drawing Sheets

(56) References Cited

OTHER PUBLICATIONS

R. Freedman, N. Heaton, M. Flaum, G.J. Hirasaki, C. Flaum, M. Hurlimann, "Wettability, Saturation, and Viscosity From NMR Measurements", SPE Journal, Dec. 2003, pp. 317-327.

W. Looyestijn, J. Hofman, "Wettability Index Determination by Nuclear Magnetic Resonance", SPE 93624, pp. 1-8.

Official Decision of Grant for the equivalent Russian patent application No. 2010130459 issued on Nov. 2, 2012.

* cited by examiner

Kro TO Krw RATIO FOR OIL WET AND WATER WET CONDITIONS

METHOD FOR CALCULATING THE RATIO OF RELATIVE PERMEABILITIES OF FORMATION FLUIDS AND WETTABILITY OF A FORMATION DOWNHOLE, AND A FORMATION TESTING TOOL TO IMPLEMENT THE SAME

FIELD OF INVENTION

This is a division of U.S. patent application Ser. No. 11/963,758, filed Dec. 21, 2007

The present invention generally relates to characterization of formation fluids in a reservoir, and more specifically relates to determination of relative permeability ratio of formation fluids and wettability of the formation downhole.

BACKGROUND OF THE INVENTION

Wireline formation testing data are essential for analyzing and improving reservoir performance and making reliable predictions, and for optimizing reservoir development and management.

Knowing the ratio of the relative permeability of formation fluids may allow for more accurate prediction of oil displacement by water and therefore of reservoir production.

Wettability is also a very important parameter in reservoir engineering as it is needed for accurate production predictions. Wettability exerts a profound influence on the displacement of oil by water from oil producing fields. Therefore, accurate predictions on the development of oil and gas reservoirs depend on the wettability assumptions. In particular, during early production of a reservoir, such as during the exploration well and/or appraisal well stages, characterizing wettability is one important parameter that is used in reservoir engineering.

Measuring a certain wettability index in-situ with the available techniques is challenging. Specifically, it is generally very difficult to characterize or qualify formation wettability, so wettability is measured indirectly through other reservoir properties that affect wettability, such as relative permeability, capillary pressure, or water saturation profile in the transition zone.

Elshahawi et al., Capillary Pressure and Rock Wettability Effects on Wireline Formation Tester Measurements, SPE 56712, have described a way to measure capillary pressure in-situ, from which an assumption on the formation wettability can be made.

Freedman et al., Wettability, Saturation, and Viscosity from NMR Measurements, SPE Journal, December 2003 or Looyestijin et al., Wettability Index Determination by Nuclear Magnetic Resonance, SPE 93624 have also developed a theory to deduce a wettability index from NMR transverse relaxation time T2, but to the inventors' knowledge it has not been tried in-situ to this time.

U.S. Pat. No. 7,032,661 B2 describes a method and apparatus for combined NMR and formation testing for assessing relative permeability with formation testing and nuclear magnetic resonance testing.

SUMMARY OF THE INVENTION

A method and apparatus according to the present invention relate to in-situ determination of the ratio of oil and water relative permeabilities and rock wettability, using formation testing.

A method according to the present invention includes pumping formation fluid from the reservoir using a formation testing tool, such as Schlumberger's Modular Formation Dynamics Tester (MDT) wireline tool, separating the fluid components (water and hydrocarbons) using, for example, but not limited to a pump, measuring in real time the physical characteristics of the fluid slugs with downhole fluid analysis (DFA) tools of a formation tester, and calculating the ratio of relative permeabilities of formation fluids and wettability of the formation based on the measured characteristics of the formation fluids.

According to an aspect of the present invention, the characteristics that are measured are fluid type (e.g. water or hydrocarbon), fluid viscosity and fluid flowrate.

According to another aspect of the present invention, for efficient results, the method is applied in transient zones where both water and oil are produced.

Other features and advantages of the present invention will become apparent from the following description of the invention which refers to the accompanying drawings.

DETAILED DESCRIPTION

An objective of the present invention is downhole formation evaluation for the determination of the relative permeability ratio in downhole conditions. Downhole as used herein refers to a subsurface location in a borehole.

According to one aspect of the present invention, an existing formation tester tool, for example, the Modular Formation Dynamics tester (MDT) of Schlumberger, and downhole fluid analysis techniques, such as but not limited to, optics and viscosity measurements are used to implement a method according to the present invention.

In a method according to the present invention, the ratio of relative permeability of two formation fluids (e.g. oil and water) obtained downhole is calculated using real time measurement of viscosity and flow rate of each fluid in real time. In this, the disclosure herein contemplates that any suitable viscometer, for example, a DV-Rod Fluid Viscosity sensor from Schlumberger, or a vibrating wire viscometer, may be utilized for measurement of viscosity.

Darcy's law relates the flow rate of a formation fluid to its relative permeability and viscosity as follows:

$$q_\varphi = \frac{kk_{r\varphi}}{\eta_\varphi} A \nabla P_\varphi$$

where $q_\phi$, is the flow of the phase $\phi$, k is the formation absolute permeability, $k_{r\phi}$ is the relative permeability of phase $\phi$, A is the cross sectional area of flow and $\nabla P_\phi$ is the pressure gradient of phase $\phi$.

Therefore, for water, $$q_w = \frac{kk_{rw}}{\eta_w} A \nabla P_w$$

and for oil, $$q_o = \frac{kk_{ro}}{\eta_o} A \nabla P_o$$

Taking the ratio between the two flows:

$$\frac{q_o}{q_w} = \frac{\frac{k_{ro}}{\eta_o} \cdot \nabla P_o}{\frac{k_{rw}}{\eta_w} \cdot \nabla P_w} = \frac{k_{ro} \cdot \eta_w}{k_{rw} \cdot \eta_o} \cdot \left(1 + \frac{\nabla P_c}{\nabla P_w}\right)$$

where $\nabla P_c$ is the capillary pressure gradient. Note that the capillary pressure is defined as $P_c = P_o - P_w$. It is assumed that the pressure gradient/drawdown is large enough to overcome the capillary pressure, therefore, it can be neglected compared to $\nabla P_w$. The equation simplifies to, $$\frac{q_o}{q_w} = \frac{k_{ro}\eta_w}{k_{rw}\eta_o}$$

Thus, $$\frac{kr_o}{kr_w} = \frac{q_o\eta_o}{q_w\eta_w} \quad \text{(Equation A)}$$

That is, the ratio of the relative permeability of one formation fluid (e.g. oil) to the relative permeability of another formation fluid (e.g. water) can be obtained by dividing the product of the flow rate ratio and viscosity of one formation fluid by the product of the flow rate and viscosity of another formation fluid.

Figure 1:
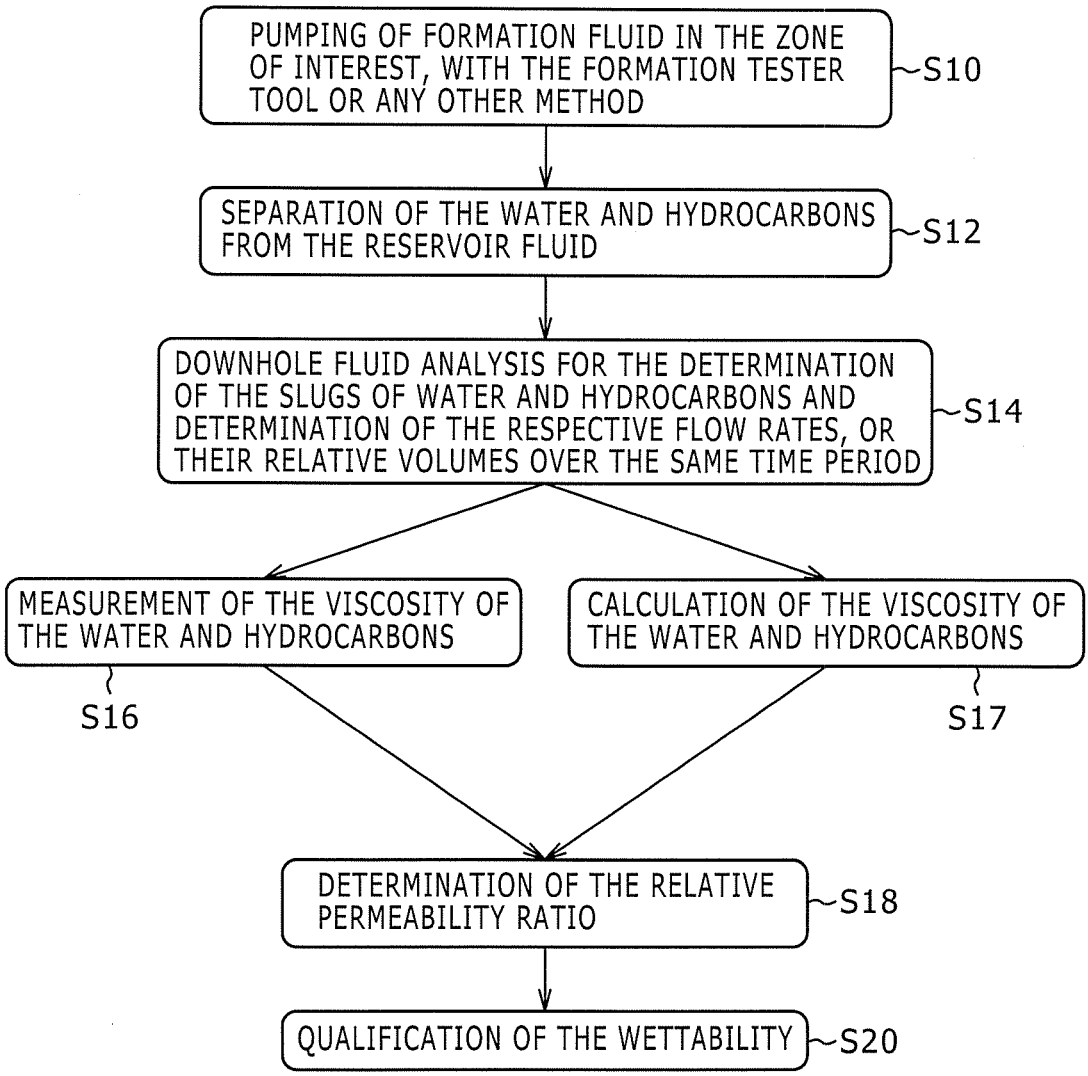
FIG. 1 sets forth the steps in a method according to the present invention.
Figure 3:
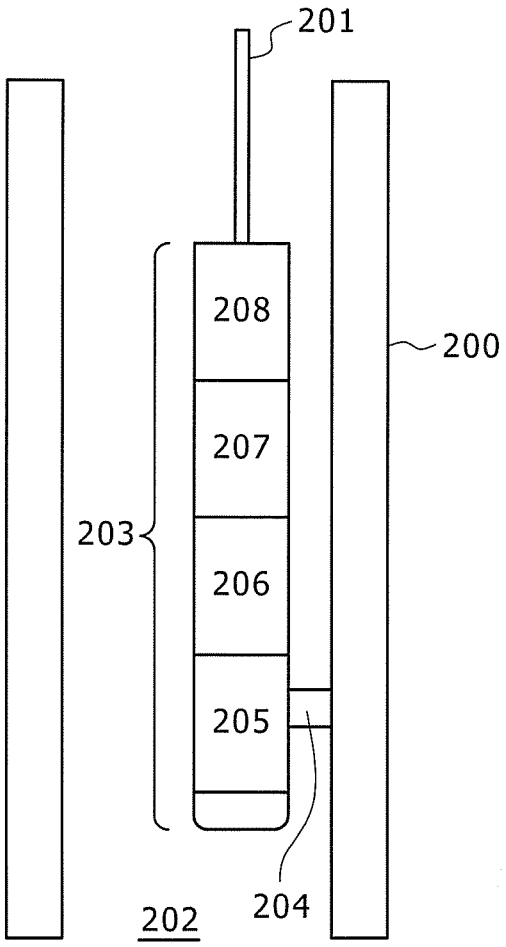
FIG. 3 schematically illustrates a tool for implementing a method according to the present invention.

Referring to FIG. 1, in a method according to an embodiment of the present invention, first a sample of formation fluid is obtained in a zone of interest downhole S10 using preferably pumping or the like. A formation tester tool, for example, a Modular Formation Dynamics Tester (MDT) available from Schlumberger (assignee of the present application), is suitable for obtaining a sample of formation fluid. FIG. 3 schematically illustrates a modular dynamic tester. Formation fluid (particularly in a transition zone of a reservoir) typically includes a water phase and an oil phase. Thus, in the next step S12 the water phase is separated from the oil phase. Thereafter, downhole fluid analysis (DFA) S14 is carried out on each of the separated fluids to determine whether it is the water phase or the oil phase. DFA S14 also measures the flow rate of each respective fluid. A suitable tool to carry out DFA S14 can be a DFA tool available from Schlumberger (assignee of the present application), which may include, for example, optics, and density and viscosity sensors. After identification of each of the separated fluids, the viscosity of each fluid is measured S16. Alternatively, viscosity of each fluid phase may be calculated S17. Next, the determined viscosity and the determined flow rate of each fluid is used to calculate the ratio of the relative permeability of the two fluids S18 (i.e. oil and water) using Equation A set forth above. Therefore, wettability is qualified or characterized S20.

According to another aspect of the present invention, wettability of the formation can be estimated using the calculated ratio of the relative permeabilities of the formation fluids, and the water saturation of the formation. Specifically, referring to FIG. 2A reproduced from Buckles et al., Toward Improved Prediction of Reservoir Flow Performance, Los Alamos, Number 1994 which graphically illustrates relative permeability values as a function of water saturation, a water saturation value can be used in conjunction with the calculated ratio of relative permeabilities of the formation fluids to qualify the wettability of the formation.

Figure 2A:
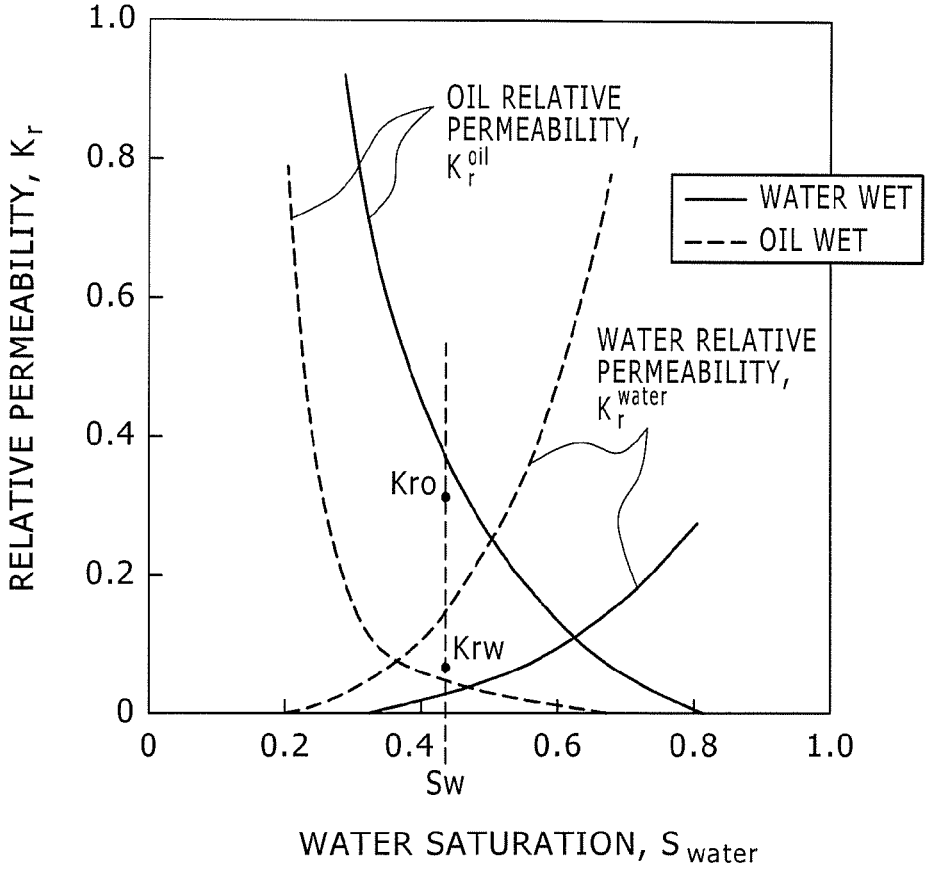
FIG. 2A graphically illustrates relative permeability values as a function of water saturation in a formation.
Figure 2B:
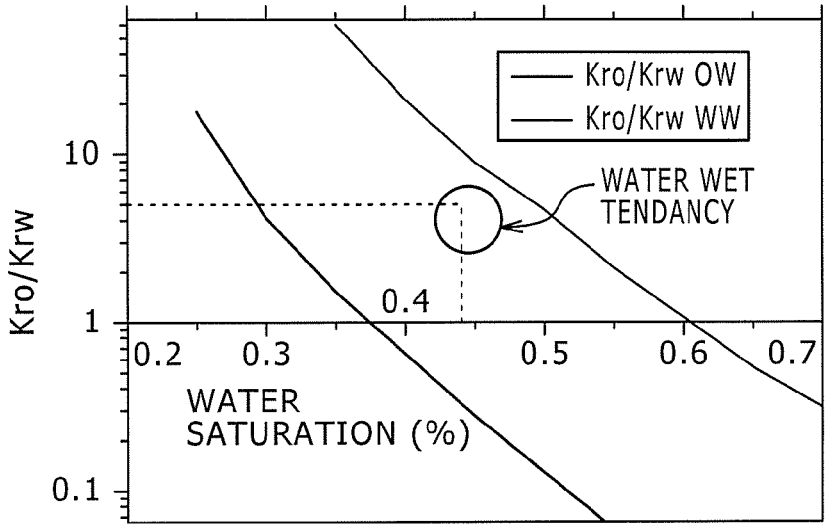
FIG. 2B illustrates a calculated ratio of Kro/Krw as a function of water saturation based on the data from FIG. 2A.

FIG. 2A is an illustration of the relative permeabilities of water and oil. Such a graph can be drawn for a typical rock category, such as sandstones and limestones. From this graph, one can calculate the graph presented in FIG. 2B that represents the ratio of $K_{ro}$ to $K_{rw}$ as a function of water saturation. Water saturation can be provided by, for example, electrical logs. The ratio of $K_{ro}$ to $K_{rw}$ can be provided, according to the Formula A, knowing the ratio of oil flow rate and water flow rate, or, the equivalent, the ratio of oil volume by water volume over the same period of time. The viscosity can be either directly measured downhole, using viscosity sensors or any other sensor that can give viscosity as a side product, or can be calculated from the equation of states, knowing the composition, pressure and temperature for the oil and knowing the salinity, pressure and temperature for the water, or any other way to determine the viscosity of water and oil, or directly its ratio. Knowing the water saturation and the ratio of $K_{ro}$ to $K_{rw}$ one can characterize the tendency of wettability of the rock. For example (shown in the FIG. 2B) if there is a water saturation of 0.44 and a ratio of $K_{ro}$ to $K_{rw}$ of 5, the plot is close to the "water wet curve", showing a strong water wet tendency.

A method according to the present invention can be implemented using a downhole formation testing tool. Referring specifically to FIG. 3, the downhole formation tester tool according to one embodiment includes a seal probe 204 to establish communication between a reservoir formation 200 and an entry port of a flow line in a borehole 202, a probe module 205 to control seal probe 204 and set it at the desired depth, a separator module 206, a downhole fluid analysis module 207, a pump module 208, and formation tester tool conveyance 201, which can be either a wireline, a drill stem, a coiled tubing, a production tubing, or another known mechanism for deploying a downhole formation tester tool. The module configuration is not limited to the previous description and the order of the module can be changed or other modules can be added. In some cases, pump module 208 can be used as a separator, in which case the separator itself is not necessary. In such a case, pump module 208 would be disposed in the position of separator 206.

Note that a tool according to the above embodiment is of the wireline variety. It should, however, be noted that a tool that is conveyed via a pipe is within the scope and spirit of the present invention. A method according to the present invention thus can be applicable to drilling and measurement applications, testing, completion, production logging, permanent fluid analysis, and in general to any method related to downhole wettability measurements.

The downhole fluid analysis module should include at least the capability to distinguish between water and oil (such as but not limited to an optical differentiator), a viscosity sensor and a flow meter. In one preferred embodiment, the flow can be measured directly from the pump.

The method can be used with, but not limited to, wireline formation tester tools such as Modular Formation Dynamics Tester (MDT) available from the assignee of the present invention. Thus, a method according to the present invention can be applicable to drilling and measurement applications, testing, completion, production logging, permanent fluid analysis, and in general to any method related to downhole wettability measurements.

Figure 4:
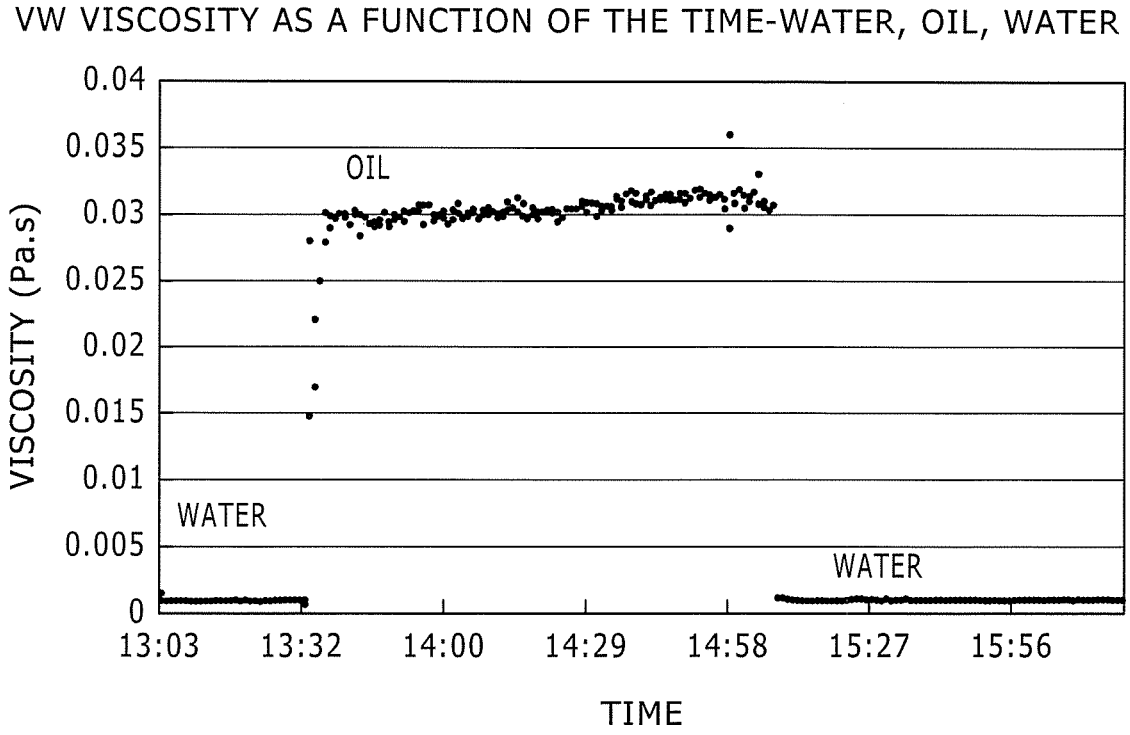
FIG. 4 illustrates an example of measured values for the viscosity of oil/water as a function of time.

The procedure of formation testing to determine the relative permeability ratio can be as follows. The conveyed formation tester tool 203 is positioned at the desired downhole depth in the borehole 202 at the depth of formation of interest 200. The seal probe 204 controlled by the probe module 205 is then operated to create a seal between the borehole and the formation to create continuity between the borehole and the tool flow line. As the seal is established, the formation fluid is pumped using the pump module 208 through the flow line of the tool. The water and oil phases of the formation fluid are separated in the separator, which can be for example the separator module 206 or the pump module itself 208. The slugs of fluids, water and oil, are then sent to the downhole fluid analysis module 207 where they are identified as either water or oil, their viscosity is determined, and their flow rates are measured. The viscosity can be measured with, for example, a vibrating wire sensor or a DV-Rod sensor, which may be implemented in wireline formation testers. Other means and methods for viscosity determination (measurement and/or calculation) can be employed without deviating from the scope and spirit of the present invention. FIG. 4 illustrates a laboratory measurement of water and oil (viscosity standard S20) slugs by a vibrating wire sensor. The flow rate can also be measured with the pump volume itself and the relative flow rate of oil and water can be determined from the relative volumes of oil and water. Knowing the flow rates and the viscosity of both phases, the relative permeability ratio can therefore be determined, using the equation described above, e.g. Equation A. The formation wettability can be determined using the relationships set forth in FIG. 2.

Figure 5:
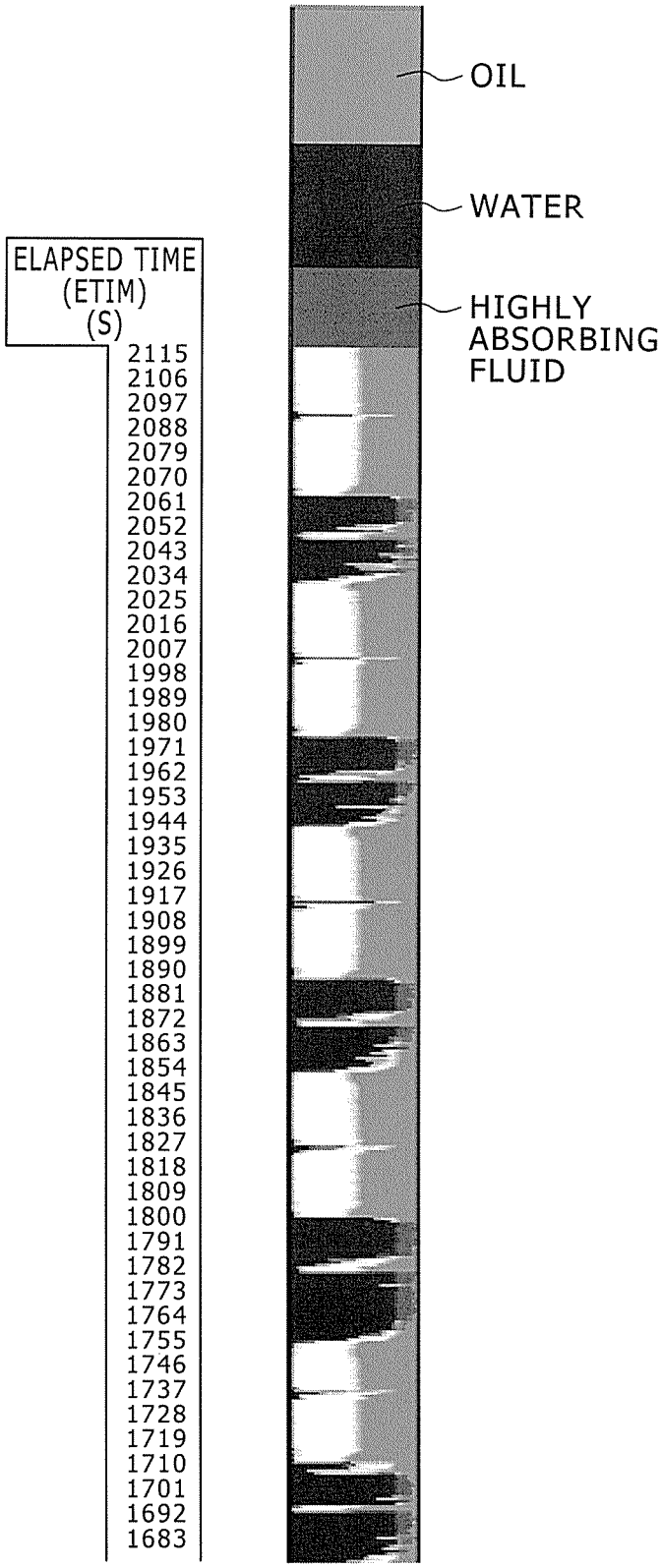
FIG. 5 illustrates an example of a DFA log showing volume ratio of oil slug and water slug.

Referring to FIG. 5, it should be noted that inside the narrow flow line of the formation tester, equal velocity for oil slug flow and water slug flow can be assumed. Thus, observed oil/water slug volume ratio is equal to oil/water flow ratio.

In one embodiment, a method according to the present invention may be carried out in a transition zone where water and oil phases are present. To be representative of the formation characteristics, all those measurements should be carried out during the steady state flow.

It is further noted that a method according to the present invention can be employed at an early stage of production, and repeated during the lifetime of the reservoir.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A tool for determining the ratio of relative permeability of downhole fluids obtained from a downhole formation, comprising:

a probe module that includes a flow line;

a pumpout module operatively coupled to said flow line;

a downhole fluid analysis module configured to measure a viscosity and a flow rate of a first formation fluid and a second formation fluid;

a calculator module configured to calculate a ratio of relative permeabilities of said first formation fluid and said second formation fluid; and a separator to separate said first formation fluid from said second formation fluid, wherein said calculator module calculates said ratio by dividing a product of said flow rate and said viscosity of said first fluid with a product of said flow rate and said viscosity of said second fluid to obtain a ratio of the relative permeability of said first fluid to that of said second fluid.

2. The tool of claim 1, wherein said calculator module is further configured to estimate wettability of said downhole formation based on said ratio and water saturation of said formation.

3. The tool of claim 2, wherein said water saturation is determined based on electrical logs of said formation.

4. The tool of claim 2, wherein said viscosity of said first and second formation fluids are measured using a vibrating wire sensor or DV-Rod sensor.

5. The tool of claim 1, wherein said formation fluids are separated in said pump module.

* * * * *